US009631397B2

(12) United States Patent
Bertato

(10) Patent No.: US 9,631,397 B2
(45) Date of Patent: Apr. 25, 2017

(54) RAILING SYSTEM

(71) Applicant: Maurizio Bertato, Uxbridge (CA)

(72) Inventor: Maurizio Bertato, Uxbridge (CA)

( * ) Notice: Subject to any disclaimer, the term of this patent is extended or adjusted under 35 U.S.C. 154(b) by 1143 days.

(21) Appl. No.: 13/694,840

(22) Filed: Jan. 10, 2013

(65) Prior Publication Data

US 2014/0191175 A1 Jul. 10, 2014

(51) Int. Cl.

| | |
|---|---|
| ***E04H 17/16*** | (2006.01) |
| ***E04F 11/18*** | (2006.01) |
| *E04H 17/18* | (2006.01) |
| *E04H 4/06* | (2006.01) |

(52) U.S. Cl.

CPC ..... *E04H 17/16* (2013.01); *E04F 11/1834* (2013.01); *E04F 11/1853* (2013.01); *E04F 2011/1831* (2013.01); *E04H 4/06* (2013.01); *E04H 17/18* (2013.01)

(58) Field of Classification Search

CPC . E04F 11/1817; E04F 11/1834; E04F 13/081; E04F 11/1853; E04F 2011/1831; E04H 17/1421; E04H 17/1413; E04H 17/1417; E04H 17/16; E04H 17/161; E04H 17/168; E04H 17/18; E04H 4/06; E05D 5/0246; E05D 5/0215; E04B 2/825; F16M 13/00

USPC ..... 52/204.72, 208, 235, 716.8, 762, 764, 52/770; 16/252; 256/31, 19, 24–27, 60, 256/68, 69, 73, DIG. 5

See application file for complete search history.

(56) References Cited

U.S. PATENT DOCUMENTS

| | | | | |
|---|---|---|---|---|
| 3,766,599 | A * | 10/1973 | Ullman, Jr. | 16/257 |
| 5,867,869 | A * | 2/1999 | Garrett et al. | 16/252 |
| 6,070,294 | A * | 6/2000 | Perkins et al. | 16/252 |
| 6,349,517 | B1 * | 2/2002 | Manley et al. | 52/239 |
| 6,643,898 | B1 * | 11/2003 | Cameron et al. | 16/382 |
| 6,704,966 | B1 * | 3/2004 | Kao | 16/252 |
| 6,827,320 | B2 * | 12/2004 | Yeh | 248/220.22 |
| 2006/0097237 | A1 * | 5/2006 | McGregor | 256/24 |
| 2012/0261631 | A1 * | 10/2012 | Schopf et al. | 256/24 |

* cited by examiner

*Primary Examiner* — Daniel P Stodola
*Assistant Examiner* — Nahid Amiri

(57) ABSTRACT

A railing system providing an aesthetically pleasing appearance and unobstructed view and having a plurality of railing posts defining planar side walls and fastening bases, clamp fastening openings formed from side wall to side wall through the posts, clamp units secured on opposite sides of the posts, by fastenings passing through the clamp fastening openings, and, glass panels supported by the clamp units between the posts.

8 Claims, 4 Drawing Sheets

RAILING SYSTEM

FIELD OF THE INVENTION

Figure 1:
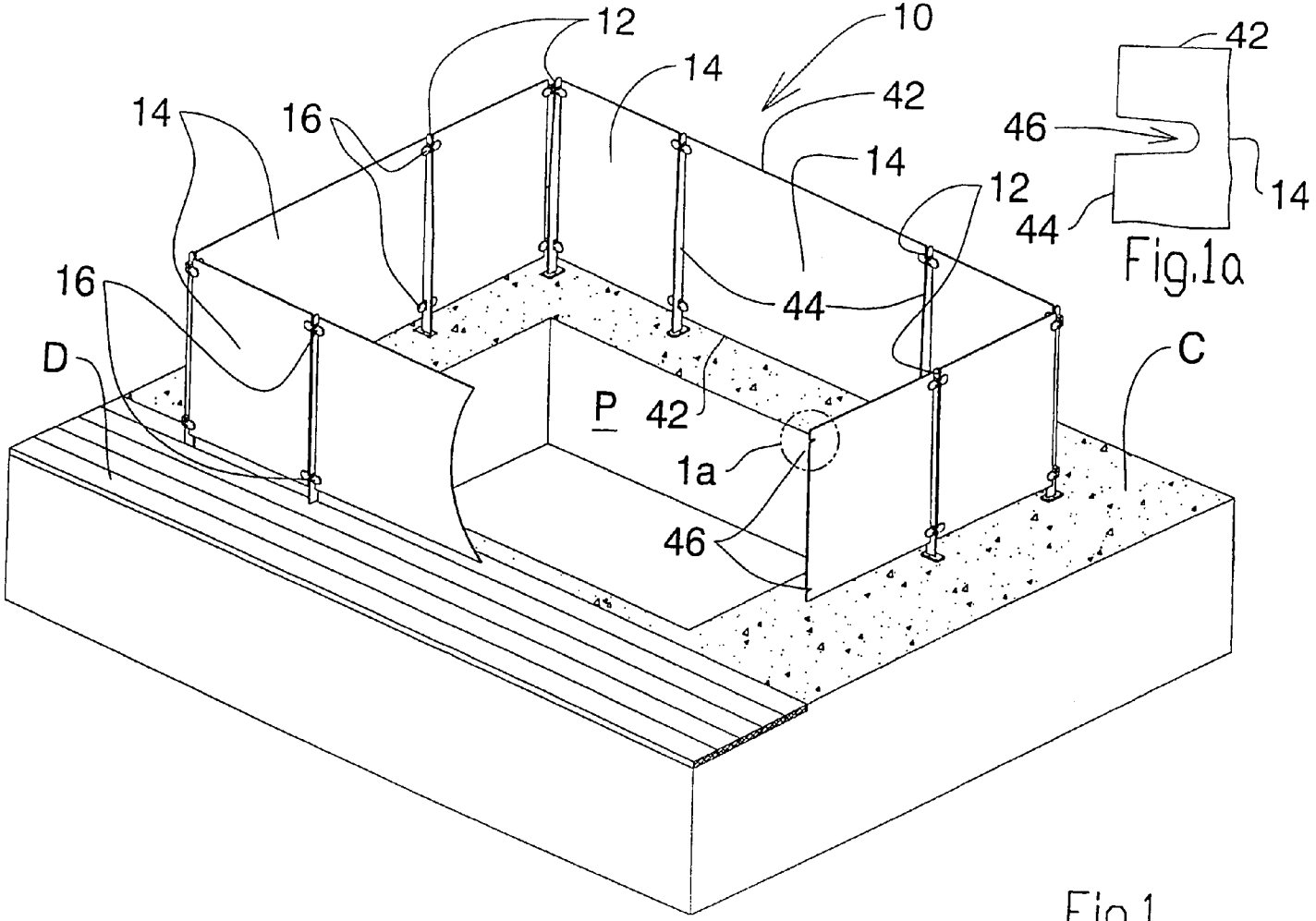

The invention relates to a railing system, in which the railing has panels consisting of tempered glass, and in which the railing has railing posts with a minimum profile to enhance the visual appearance of the railing.

BACKGROUND OF THE INVENTION

Railings in the past have conventionally been made of steel, or in some cases ornamental iron or cast aluminum is used for a more pleasing effect. However all such railings consist of a series of railing posts spaced apart from each other and a panel of some kind of railing material either metal panels or wire mesh or ornamental cast metal supported between the posts. In many situations however it is becoming apparent that consumer preference, and utility, are moving away from the use of wooden railing posts, since they obstruct the view. Wire mesh panels are practical but are generally speaking utilitarian and detract from the appearance of the property. Ornamental metal or structure such as iron or aluminum is generally used for its decorative effect. Clearly ornamental metal is more expensive than wire mesh. In addition to these factors however, there are many situations in which it is desirable to erect a barrier or railing which is less obtrusive to the eye. In particular, on, for example domestic property where a swimming pool is installed, it is necessary to erect a railing around the swimming pool. However if the railing obstructs the view then it will not be possible for a supervisor to watch activities in the pool unless he or she is actually within the borders of the railing. Similarly, it is becoming common to provide outdoor patios with railings, for simple reasons of safety. Many residences, and apartment towers incorporate balconies with railings, also known as guards, which are essential on such balconies. Again it is desirable to provide railings in those situations which are aesthetically pleasing, and do not detract from the view.

For these reasons panels of tempered glass have been found to be much more satisfactory and more durable and permit a railing to be erected without substantially impeding the view. The erection of a railing consisting of glass tempered panels supported between spaced apart posts does however present problems. The railing posts themselves would be made of wood or metal, having a certain rate of thermal expansion. Glass on the other hand will have a widely different rate of thermal expansion. Fastening such glass panels between railing posts then poses serious problems. Any form of fastening used to engage the glass panels must be capable of permitting the differential rates of expansion and contraction due to thermal forces. In addition however, it is apparent that any such fastening systems must also be adaptable to the railing posts themselves which support the railing.

Another factor which has also become apparent, is that consumers prefer railing posts which are as far as possible, minimal in profile. In some cases of course, conventional wooden railing posts must be used, and in these cases it is preferable that the fastening systems adapted for engaging the glass panels shall also be adaptable to railing posts of other profiles. However metal profiled railing posts are capable of supporting the glass panels, and will have a slimmer profile than a conventional wooden post.

BRIEF SUMMARY OF THE INVENTION

With a view to satisfying the various conflicting requirements for an aesthetically pleasing system, the invention comprises a plurality of railing posts, metal clamp units, mountable on the railing posts, and a plurality of glass panels, the glass panels having slotted recesses, for receiving the clamp units.

Preferably the railing posts are of stainless steel; defining planar side walls and base fastening flanges; and clamp fastening openings formed from side wall to side wall through the posts, and clamp units secured on opposite sides of said railing posts, by fastenings passing through said openings;

Preferably such railing posts define inner side edges which are linear from bottom to top, angled outer side edges defining an angle midway between the bottom and the top, and a radiussed top curve portion joining said inner side edge with said outer side edge. Preferably the base for the railing posts is a flange welded transversely to the bottom of said railing post, and openings formed in said flange for receiving fastenings there through.

In another embodiment the base comprises a downward extension of said railing post co axial with and co planar with said railing post, and fastening openings formed through said downward extension.

Preferably the clamp units include fastening pins received in said recesses, and resilient sleeves on said fastening pins;

Preferably there are corner connectors supported on a railing post at a corner, and clamp units secured to said connectors.

The clamp units are advantageously made in two portions consisting of outer and inner portions, and resilient glass plate engaging members, and clamping screws extending between the two inner and outer portions.

Preferably when used on wooden fence posts, the clamp units will be provided with additional contact plates, for contacting the wood surface on each side of the post. Preferably, the corner connectors are provided with locking screws, which may be operated to lock the corner at a preset angle.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

Figures 2A, 2B, 2C:
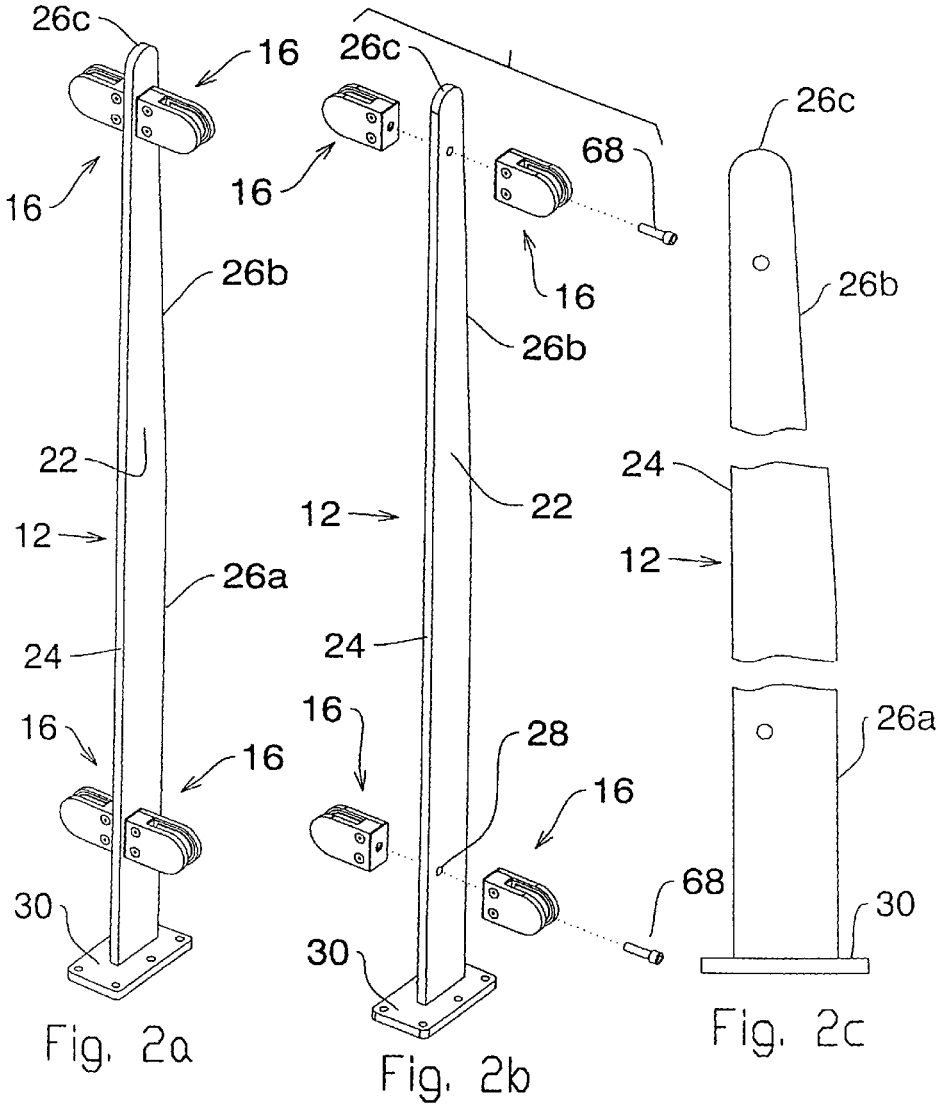
Figure 2D:
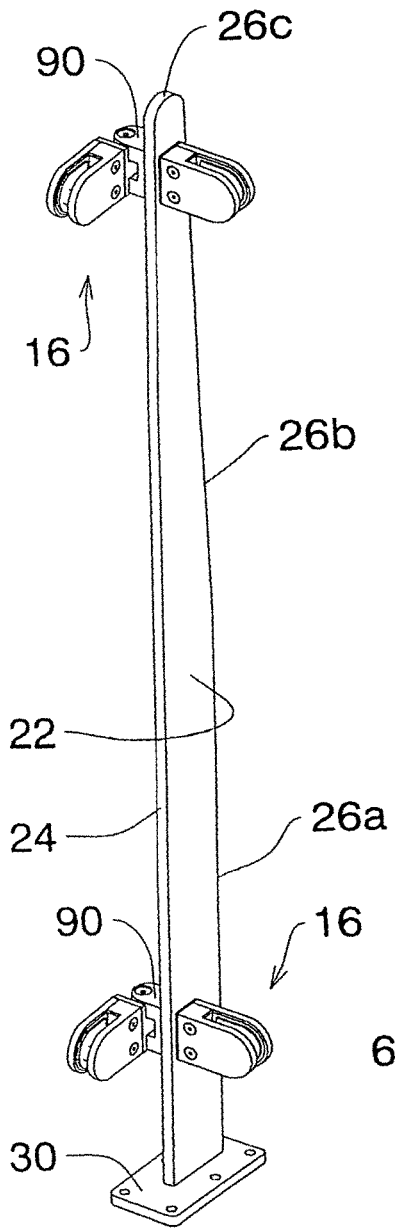
Figure 2E:
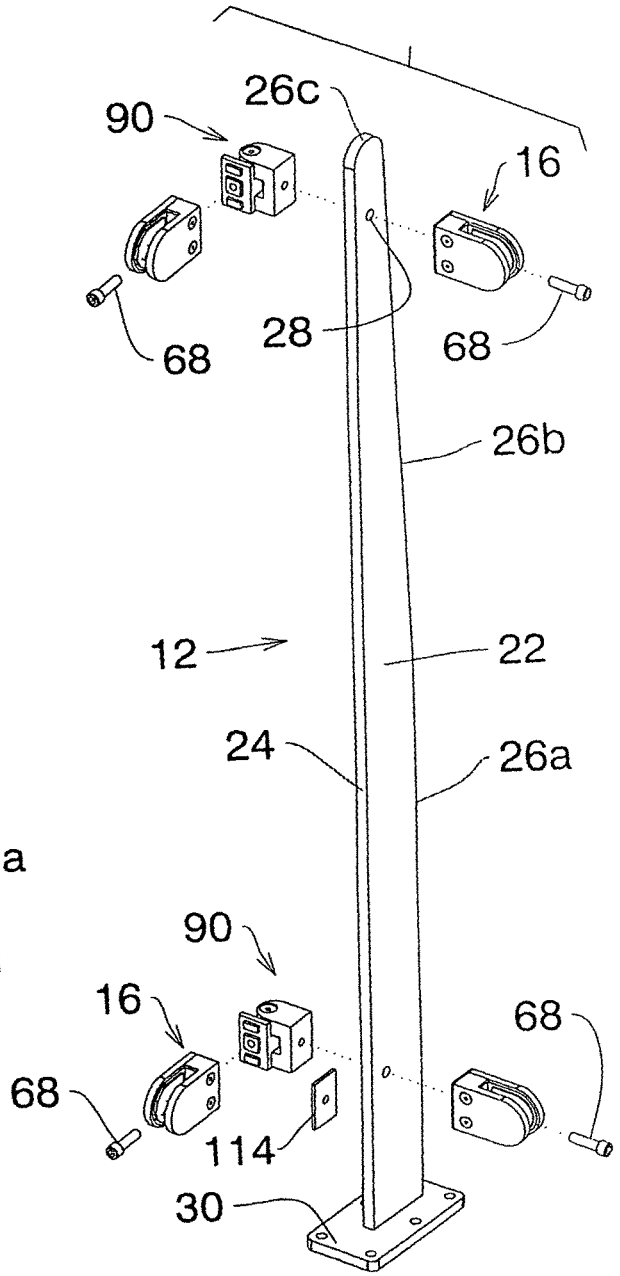
Figure 3A:
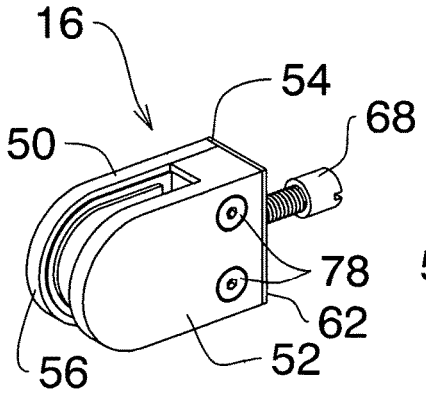
Figure 3B:
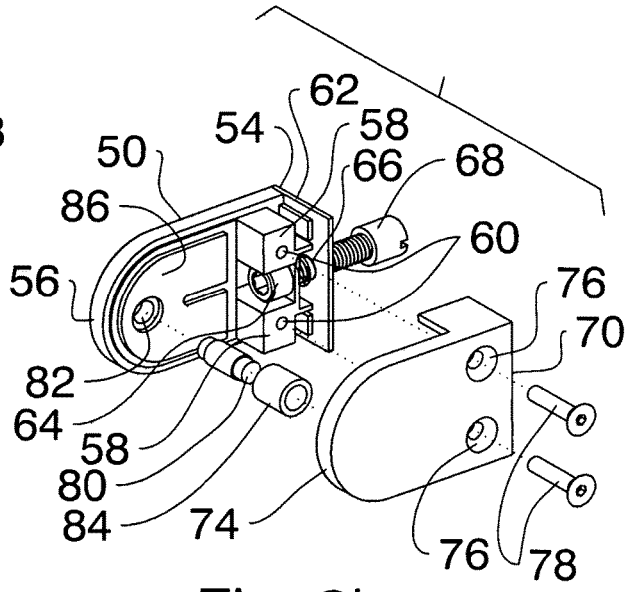
Figure 4A:
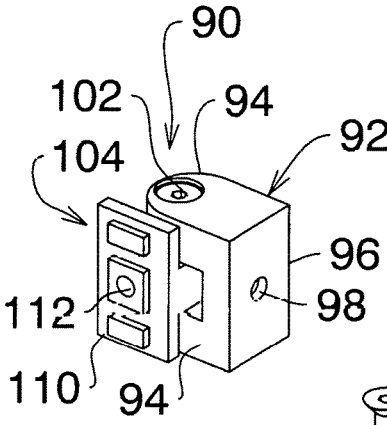
Figure 4B:
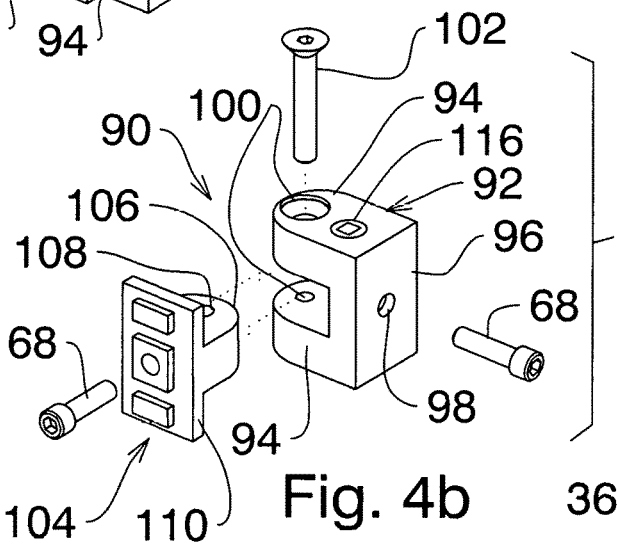
Figure 5:
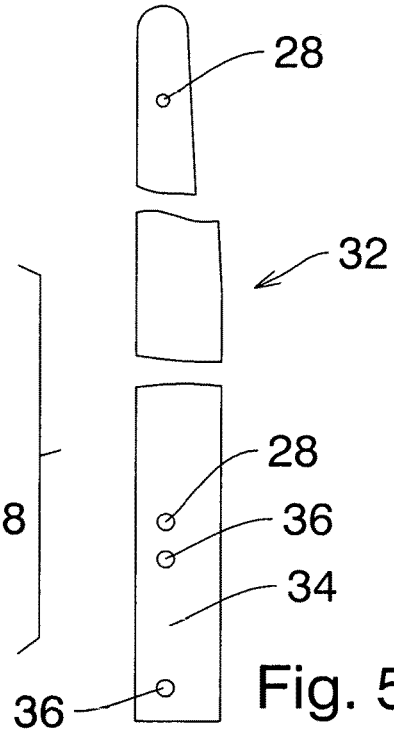

FIG. 1 is a perspective illustration of a railing illustrating the invention, shown erected partly around a swimming pool and partly around a wooden deck;

FIG. 1*a* is an enlarged perspective of detail 1*a* of FIG. 1;

FIG. 2*a* in a perspective of a railing post showing clamp units for holding glass panels;

FIG. 2*b* is a perspective corresponding to 2*a* with the clamp units shown exploded;

FIG. 2*c* is a side elevation of a first embodiment of a railing post;

FIG. 2*d* is a perspective similar to 2*a* showing a railing post at a corner with corner connectors;

FIG. 2*e* is a perspective similar to 2*c* showing the clamp units and corners members exploded;

FIG. 3*a* is an enlarged perspective of a clamp unit;

FIG. 3*b* is a perspective similar to 3*a* with the clamp unit exploded;

FIG. 4*a* is a perspective of a corner connector;

FIG. 4*b* is a perspective similar to 4*a* showing the corner connector exploded; and, FIG. 5 is a side elevation of another embodiment of railing post.

DESCRIPTION OF A SPECIFIC EMBODIMENT

As shown in FIG. 1, the invention is there illustrated in generally schematic form. It will be seen that, for example, there is shown a back yard swimming pool indicated generally as (P) which is provided with a concrete border (C). A wooden deck (D) may be located along one side of the pool (P).

This of course is unlikely to be a typical domestic situation, but the illustration is merely intended to indicated various possible locations for a railing system. The railing system is indicated generally as (10) and will be seen to comprise a series of railing posts (12), spaced apart around the pool and along one side of the deck. Between the posts, a plurality of glass panels (14) are supported. Clamp units (16) are shown attached to the railing posts (12) and engage the edges of the panels (14). The railing posts (12) in this illustration are formed of planar metal plates, in a manner to be described below, and the panels (14) are preferably tempered glass panels of a type well known in the art.

Railing Posts (12)

In order to provide a substantially unobstructed view through the railing, and to provide a minimum of interference with the aesthetic and landscaped appearance around the railing, each railing post (12) will be seen to comprise a single solid stainless steel planar vertical plate member having side surfaces (22) which are planar and lie in parallel spaced apart planes. Inside vertical linear edge (24) defines one edge of the member, and an angled outer edge (26*a*-26*b*), defines the opposite edge. The angled edge (26*a*) is substantially vertical and linear for a first portion of its length and then angled in a tapering fashion (26*b*) and terminates at the top of the post (12) in a radiused curve portion (26*c*).

Clamp fastening openings (28) are formed from side wall to side wall through the post. In the case of such railing posts (12) which are to be mounted on a solid concrete or other solid base, each member has a base which in this case is a horizontal rectangular flange (30), which is welded to a post (12), and is provided with suitable openings to receive fastenings such as screws or concrete expansion bolts or the like (not shown).

The post (12) is formed of solid stainless steel throughout, in the preferred case, to minimize maintenance.

However the invention is not limited specifically to stainless steel as the fabrication material but may include painted steel, or aluminum or even wood, depending upon the particular application, and of the taste of the consumer.

The linear edge (24) is arranged towards the inwardly facing side of the railing, when viewed in respect of FIG. 1. In other words where the railing is enclosing a space, the linear edges (24) would face inwardly towards the enclosed space. The angled linear edge (26*a*-26*b*) defines an outwardly facing edge. In this way, the necessary support for the panels (14) is provided by the railing posts (12), and the spacing enclosed by the railing is left as clear as possible from any visual or aesthetic interference by the individual railing posts.

Where such a railing is to be erected for example, on a wooden platform such as a deck (FIG. 1), then a modified form of railing post (32) (FIG. 5) may be provided. In this case, the upstanding portion of the railing post (32) is substantially identical to the railing post (12). However the base, in this case, is a downward planar axial extension (34). The axial extension (34) is simply a continuation of the upper portion of the railing post (32). The extension (34) is co-planar and co-axial with the post (32), and is provided with transverse fastening openings (36). In use, such railing posts will be secured by screws or bolts (not shown) directly to horizontal beams or joists (not shown) supporting the wooden platform, in well known manner and requiring no special description.

Glass Panels (14)

The glass panels (14) comprise in this case, rectangular shaped members, having lower and upper horizontal parallel edges (42) and vertical side edges (44). In order to secure them to the clamp units (16), the panels (14) are provided with generally U-shaped recesses (46) extending inwardly from each of the side edges (44) (FIG. 1*a*).

Clamps Units (16)

The clamp units (16) are shown in more detail in FIGS. 2*a* to 3*b*. Each clamp unit will define respective first and second clamp bodies (50) and (52).

First clamp body (50) is formed of an integral casting, typically but not exclusively, of stainless steel for resistance to weathering. The body has a generally planar outer surface, and defines a linear end (54) and at the opposite end a radiused end (56), although the radius end could be of various configurations, being either angular or linear, depending on the taste of the consumer.

Adjacent to the linear end (54), there are two fastening receiving blocks (58), respectively defining threaded receptacles (60) extending normal to the plane of the body (50). An end plate (62) extends normal to the body (50). Between the two receiving blocks (58), there is an elongated axial sleeve (64), having female threads therein, registering with a hole (66) in the end plate (62). A threaded fastening bolt (68) can be inserted through the opening and be received in the sleeve.

Second clamp body (52) defines an exterior planar surface similar to the exterior planar surface of the first clamp body (50), and defining a linear side edge (70) and a radiused side edge (74). Fastening holes (76) are formed in the body (52) to receive clamping screws (78) which pass there through and into the receiving bodies (58) in the first clamp body (50).

Panel retention pins (80) extend transversely between the two clamp bodies (50) and (52) and are received at their ends in recesses (82) in respective clamp bodies. Pins (80) are received in recesses (46) in glass panels (14). Preferably, a resilient cushion sleeve (84) will be provided on pins (80).

In addition, and preferably, there will be resilient pads (86) positioned on the inward faces of the clamp bodies (50) and (52) for engaging opposite sides of the glass around the recess.

Corner Connectors (90)

Referring to FIGS. (4*a*) and (4*b*) it will be seen that the clamp units (16) may be combined with corner connectors (90) to provide for angular corners on the railing. It will be appreciated that in most cases, the railing will define right angled corners. However this is not always the case in every railing. The corner connector (90) of FIGS. 4*a* and 4*b*) will permit corners at various different angles.

The corner connector (90) consists of a hinge body (92) having a generally U-shaped configuration, with two arms (94), with a junction bar (96) extending between them. A bolt receiving hole (98) is formed in bar (96) to receive a bolt (68), from an adjacent clamp unit, and secure them both on opposite planar sides of a railing post. Hinge passages (100)

are formed through arms (94), and receive hinge pin (102). The corner connector further comprises a swivel body (104) of generally T-shaped configuration. Body (104) has a single pin block (106) having a pin passage (108), for receiving hinge pin (102). Block (106) fits between arms (94) and is rotatable relative thereto around pin (102).

An end plate (110) extends across block (106) and has a bolt receiving threaded hole (112) for connection to a clamp unit (see FIG. 2*d*) via a bolt (68).

Where the clamp units, or corner connectors are to be used on wooden railing posts, then contact plates (114) (FIG. 2*e*) will be provided on each side of the post which act in a way similar to conventional washers and spreads the load. In this way, the bolts (68) can be tightened up securely, and the contact plates will prevent the clamps or the corner connectors from being indented into the surface of the wooden post. In many cases it is desirable to be able to lock the angle of the corner connector. For this purpose, the corner connectors may be provided with locking screws (116). When the desired angle has been reached in a particular railing, then the locking screws are tightened up and the corner connector is then rigid.

The corner connector, as can be seen, allows the arrangement of a right angle corner or a non right angle corner, if desired.

In operation, the railing posts are erected at the appropriate locations with the angled sides facing outwards.

Clamp units are then assembled by fastening the first clamp bodies (50) to the railing posts.

The glass plate is then placed in position against the clamp bodies (50). The second clamp bodies (52) are then attached to the first clamp bodies (50) by bolts, and clamped against the opposite sides of the glass plate, enclosing and concealing the recesses (46) in the panels.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A railing system comprising;

a plurality of railing posts defining planar side walls and fastening bases;

clamp fastening openings formed from side wall to side wall through said railing posts;

first and second clamp bodies secured in pairs on opposite sides of said railing posts by bolts passing through said clamp fastening openings;

fastening pins extending transversely between said first and second clamp bodies in each said pair of clamp bodies, said fastening pins defining two fastening pin ends;

resilient sleeves defining sleeve ends, and open at both said sleeve ends, said sleeves being located on said fastening pins intermediate said first and second clamp bodies in each said pair, of clamp bodies;

glass panels supported by said clamp bodies between said railing posts;

side edges defined by said glass panels;

recesses formed in said side edges of said glass panels; and said fastening pins passing within said recesses of said side edges of said glass panel with said resilient sleeves positioned between said side edges of said glass panels.

2. The railing system as claimed in claim 1 wherein said railing posts are planar metal plates and define inner side edges which are linear from bottom to top, angled outer side edges defining an angle midway between the bottom and the top, and a radiussed curve portion joining said inner side edge with said outer side edge.

3. The railing system as claimed in claim 2 wherein each one of said fastening bases is a flange secured transversely to a bottom of each one of said railing posts and openings formed in each said flange for receiving fastenings there through.

4. The railing system as claimed in claim 2 including a downward extension of a railing post coaxial with and coplanar with said railing post, and fastening openings formed through said downward extension and functioning as a base for said railing post.

5. The railing system as claimed in claim 1 wherein said railing system defines at least one corner, and including corner connectors supported on a corner railing post at said corner, and pairs of said first and second clamp bodies secured to said corner connectors.

6. The railing system as claimed in claim 5, and including locking screws incorporated in said corner connectors.

7. The railing system as claimed in claim 1, further including pairs of receiving blocks formed in said first clamp body, and an axial sleeve located between said receiving blocks in said first clamp body, and including clamping screw fastening holes formed in said second clamp body registering with respective said receiving blocks in said first clamp body, and clamping screws passing through said clamping screw fastening holes in said second clamp body.

8. The railing system as claimed in claim 7 and including resilient pads on respective said first and second clamp bodies for engaging opposite sides of said glass panels around said recesses.

* * * * *